US008479520B2

(12) United States Patent
Terada et al.

(10) Patent No.: US 8,479,520 B2
(45) Date of Patent: Jul. 9, 2013

(54) GAS TURBINE COMBUSTOR

(75) Inventors: Yoshitaka Terada, Takasago (JP); Tetsu Konishi, Takasago (JP); Katsuyoshi Omae, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 745 days.

(21) Appl. No.: 12/670,207

(22) PCT Filed: Aug. 26, 2008

(86) PCT No.: PCT/JP2008/065137

§ 371 (c)(1),
(2), (4) Date: Mar. 26, 2010

(87) PCT Pub. No.: WO2009/028475

PCT Pub. Date: Mar. 5, 2009

(65) Prior Publication Data

US 2010/0192586 A1 Aug. 5, 2010

(30) Foreign Application Priority Data

Aug. 29, 2007 (JP) ..... 2007-222036

(51) Int. Cl.
*F02C 1/00* (2006.01)

(52) U.S. Cl.
USPC ..... 60/742

(58) Field of Classification Search
USPC ..... 60/740, 742, 746, 39.463; 239/132, 239/132.1, 132.3, 424
See application file for complete search history.

(56) References Cited

U.S. PATENT DOCUMENTS

| | | | | |
|---|---|---|---|---|
| 4,258,544 | A | 3/1981 | Gebhart et al. | |
| 5,415,000 | A | 5/1995 | Mumford et al. | |
| 5,570,580 | A * | 11/1996 | Mains | 60/747 |
| 2003/0024249 | A1 | 2/2003 | Akagi et al. | |
| 2003/0182945 | A1 * | 10/2003 | Runkle et al. | 60/776 |
| 2006/0010878 | A1 * | 1/2006 | Widener | 60/776 |
| 2007/0235556 | A1 * | 10/2007 | Harmon et al. | 239/132 |

FOREIGN PATENT DOCUMENTS

| | | | |
|---|---|---|---|
| JP | 55-500647 | A | 9/1980 |
| JP | 4-222305 | A | 8/1992 |
| JP | 8-5075 | A | 1/1996 |

(Continued)

OTHER PUBLICATIONS

International Search Report of PCT/JP2008/065137, maling date of Oct. 28, 2008.

*Primary Examiner* — Phutthiwat Wongwian
(74) *Attorney, Agent, or Firm* — Westerman, Hattori, Daniels & Adrian, LLP

(57) ABSTRACT

A low cost gas turbine combustor has main nozzles having a cylindrical central tube using an interior as an oil fuel path, a cylindrical outer tube disposed on an outermost periphery of the main nozzle, and a support tube disposed between the central tube and the outer tube, the central tube, the outer tube and the support tube each being formed independently. The support tube has such an internal diameter as to form a clearance becoming an insulating air layer between the support tube and an outer periphery of the central tube, and includes supporting portions formed on an axially upstream side and radially contacting an inner periphery of the outer tube groove portions formed along an axial direction between the supporting portions, and a cylindrical portion formed on an axially downstream side and having an external diameter equal to or smaller than an external diameter of the groove portions.

3 Claims, 4 Drawing Sheets

FOREIGN PATENT DOCUMENTS

| | | | |
|---|---|---|---|
| JP | 8-014566 | A | 1/1996 |
| JP | 2002-349854 | A | 12/2002 |
| JP | 3495730 | B2 | 2/2004 |
| JP | 2005-321157 | A | 11/2005 |

* cited by examiner 3
3a
3b
3c
4
4a
4b
4c
5
5a
5b
6
7
7a
7b
8
8a
8b
8c
8d
9
11
12
14
A
B

GAS TURBINE COMBUSTOR

TECHNICAL FIELD

This invention relates to a gas turbine combustor.

BACKGROUND ART

A plurality of combustors of a gas turbine are mounted annularly around a casing of the gas turbine. As shown in FIG. 3, a conventional combustor 51 has a pilot nozzle 52, and a plurality of main nozzles 53 arranged annularly around the pilot nozzle 52. In the case of a dual mode in which fuel is switched between oil fuel and gas fuel, the main nozzle 53 is of a structure having a path for passage of oil fuel and a path for passage of gas fuel. The pilot nozzle 52 also has a similar structure.

Patent Document 1: U.S. Pat. No. 4,258,544

Patent Document 2: Japanese Patent No. 3495730

DISCLOSURE OF THE INVENTION

Problems to be solved by the invention

FIGS. 4(*a*) and 4(*b*) show details of the conventional main nozzle 53. FIG. 4(*a*) is a sectional view in the axial direction of its leading end side, and FIG. 4(*b*) is a sectional view taken on line C-C in FIG. 4(*a*).

As described above, in the gas turbine combustor in the dual mode, the main nozzle 53 is of the structure having the path for passage of oil fuel and the path for passage of gas fuel. The interior of a central tube 54 serves as an oil fuel path 56 through which oil fuel passes, and an outer tube 55 is provided with gas fuel paths 57*a*, 57*b* through which gas fuel passes. Oil fuel passing through the oil fuel path 56 is at a temperature of the order of 40° C., while combustion air flowing around the main nozzle 53 is at a high temperature of the order of 450° C. To suppress thermal stress due to this temperature difference, the main nozzle 53 is formed in a perforated shape like a lotus root, as shown in FIG. 4(*b*), and its hollow parts are used as the oil fuel path 56 (central tube 54) and the gas fuel paths 57*a*, 57*b*. In the main nozzle 53, in order to accommodate a difference in thermal elongation between the central tube 54 and the outer tube 55, a rear end part of the central tube 54 is slidable in the axial direction, and is structured to use a special O ring (fluoroplastic-based rubber) for a seal between an oil chamber 61 and the central tube 54 (see FIG. 3).

As seen above, the main nozzle 53 of the dual mode gas turbine combustor has a complicated structure, and it has been desired that the structure of the main nozzle 53 be simplified, and its cost be lowered. In particular, the sectional shape of the main nozzle 53 is complicated. Usually, special elongated holes are machined in the axial direction of a bar member with the use of an elongated hole machining device, a wire cut electrical spark machine, or the like to form the bar member into a perforated shape. This has been a major factor for the high cost.

With the dual mode gas turbine combustor, moreover, coking of oil fuel has to be prevented. For this purpose, the temperature of the central tube 54 needs to be set at a specified temperature or lower at which no coking occurs. With the conventional main nozzle 53 as well, an insulating air layer 58 is formed around the central tube 54, whereby the influence of combustion air around the main nozzle 53 is lessened. As shown in FIG. 4(*b*), however, the main nozzle 53 is of a structure in which the insulating air layer 58 directly contacts the outer tube 55 in direct contact with combustion air. Thus, it is not easy to set the temperature of the central tube 54 at the specified temperature or lower. Unless the balance of heat input to the main nozzle 53 is taken into consideration, starting at the time of designing the main nozzle 53, for example, it is difficult to set the temperature of the central tube 54 at the specified temperature or lower. Not only the designing of the main nozzle 53, but its manufacture is also difficult, constituting a factor for the high cost.

As described above, the main nozzle 53 has the problem of causing a high cost because of various factors. Thus, a gas turbine combustor entailing a lower cost has been desired.

The present invention has been accomplished in the light of the above-described problems. It is an object of the invention to provide a low cost gas turbine combustor.

Means for Solving the Problems

A gas turbine combustor according to a first aspect of the invention, intended for solving the above problems, is a gas turbine combustor having main nozzles each provided with an oil fuel path for passage of oil fuel and a gas fuel path for passage of gas fuel, characterized in that the main nozzles each have a cylindrical central tube disposed at a center of the main nozzle and using an interior thereof as an oil fuel path through which oil fuel flows, a cylindrical outer tube disposed on an outermost periphery of the main nozzle, and a support tube disposed between the central tube and the outer tube, the central tube, the outer tube and the support tube each being formed independently, the support tube has such an internal diameter as to form a clearance becoming an insulating air layer between the support tube and an outer periphery of the central tube, and includes a plurality of supporting portions formed on an axially upstream side and radially contacting an inner periphery of the outer tube, a plurality of groove portions formed along an axial direction between the supporting portions, and a cylindrical portion formed on an axially downstream side and having an external diameter equal to or smaller than an external diameter of the groove portions, and spaces formed by the outer tube and the groove portions, and a space formed by the outer tube and the cylindrical portion are used as the gas fuel path in which gas fuel flows.

A gas turbine combustor according to a second aspect of the invention, intended for solving the above problems, is the gas turbine combustor according to the first aspect of the invention, characterized in that opening portions are provided in a side surface, on the axially upstream side, of the outer tube, and notches are provided by partially cutting off the supporting portions at positions where the opening portions are located, whereby gas fuel is supplied through the opening portions, and introduced from the notches to the groove portions.

A gas turbine combustor according to a third aspect of the invention, intended for solving the above problems, is the gas turbine combustor according to the first or second aspect of the invention, characterized in that the central tube has a front end and a rear end fixed by welding, and has on a rear end side thereof a coiled bend formed to be coil-shaped.

Effects of the Invention

According to the first aspect of the invention, the central tube, the outer tube, and the support tube are each formed independently. Thus, the clearance becoming the insulating air layer can be formed between the support tube and the outer periphery of the central tube by a simple structure. Hence, the influence of combustion air flowing around the main nozzle can be suppressed to prevent the coking of oil fuel. If the central tube vibrates, moreover, its vibration can be stopped by the support tube. In addition, when the main nozzle is designed and manufactured, its balance of heat input need not be taken into consideration. This makes it possible to reduce the costs of designing and manufacturing.

According to the second aspect of the invention, the main nozzle is structured such that the fluid force of gas fuel supplied to the main nozzle does not directly act on the central tube, whereby the vibration of the central tube can be prevented, and the flow of the inflowing gas fuel can be kept unimpeded.

According to the third aspect of the invention, the coiled bend can accommodate thermal elongation in the central tube and suppress thermal stress. As a result, unlike the conventional technology, the O ring becomes unnecessary, thus decreasing the number of the components, simplifying the structure, reducing the manufacturing cost, and enhancing the maintainability.

DESCRIPTION OF THE NUMERALS

Figure 1:
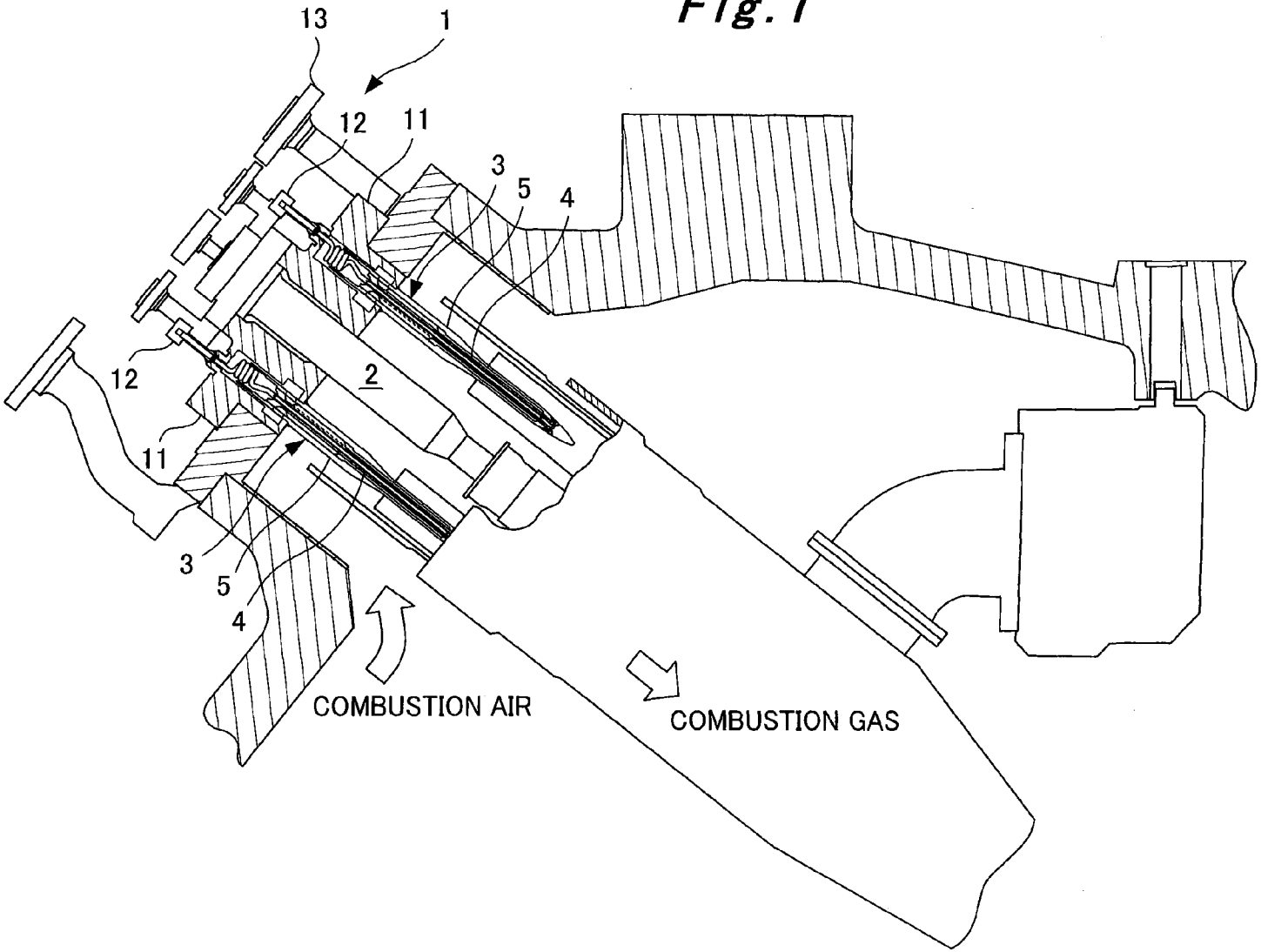
FIG. 1 is a schematic view showing an embodiment of a gas turbine combustor according to the present invention.

1 Gas turbine combustor
2 Pilot nozzle
3 Main nozzle
4 Central tube
5 Outer tube
6 Oil fuel path
7*a* Gas fuel path (groove portion)
7*b* Gas fuel path
8 Support tube
9 Insulating air layer

BEST MODE FOR CARRYING OUT THE INVENTION

Embodiments of a gas turbine combustor according to the present invention will now be described by reference to FIGS. 1 to 2.

Embodiment 1

FIG. 1 is a schematic view showing an embodiment of a gas turbine combustor according to the present invention. In the present embodiment as well, a plurality of combustors 1 of a gas turbine are mounted annularly around a casing of the gas turbine, as in the conventional technology. The combustor 1 is in a dual mode capable of switching between oil fuel and gas fuel. As shown in FIG. 1, the combustor 1 has a pilot nozzle 2, and a plurality of (for example, eight) main nozzles 3 arranged annularly around the pilot nozzle 2. Both the pilot nozzle 2 and the main nozzle 3 are of a structure having an oil fuel path for passage of oil fuel and a gas fuel path for passage of gas fuel.

Figures 2A, 2B, 2C:
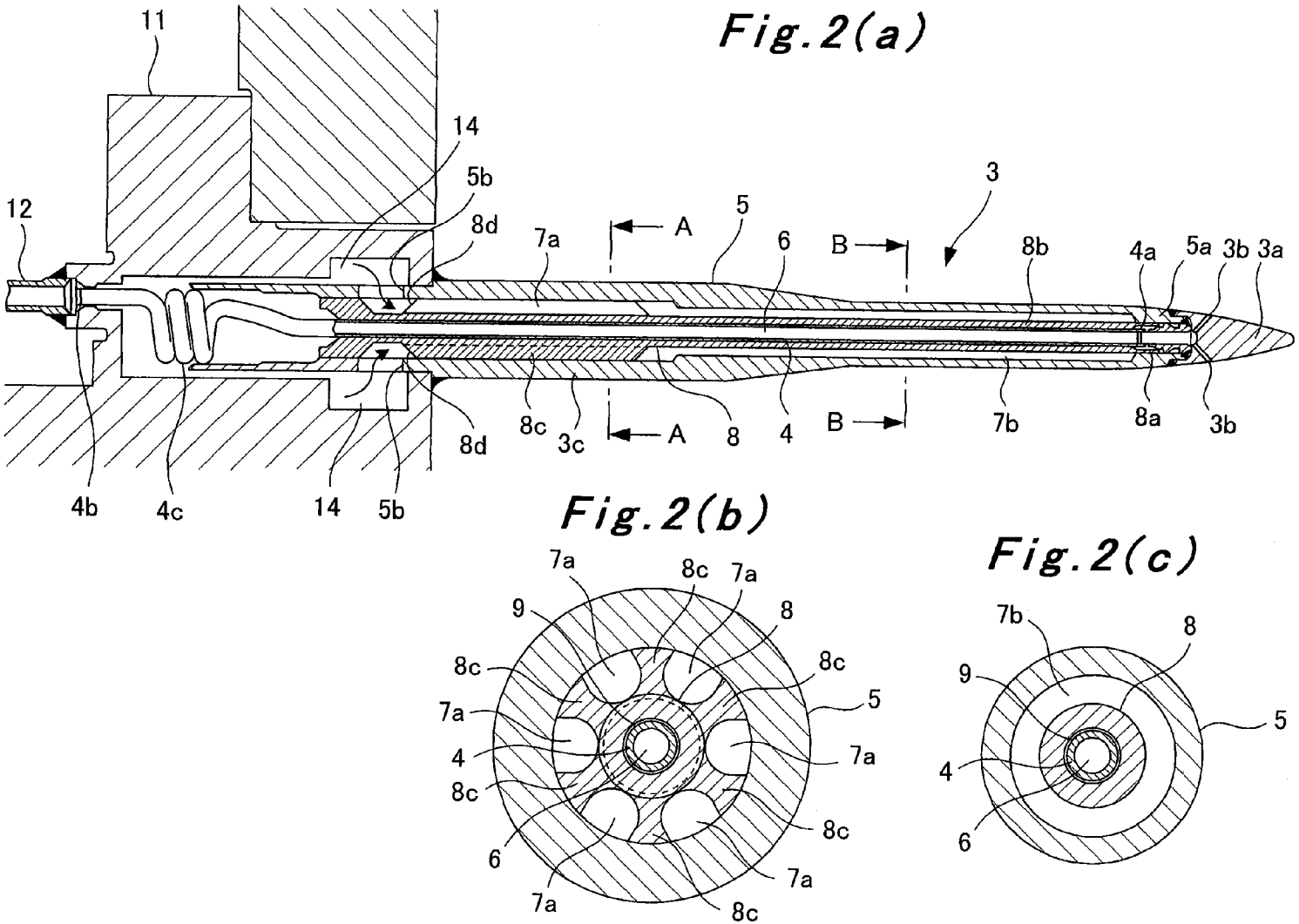
FIGS. 2(*a*) to 2(*c*) are sectional views of a main nozzle in the gas turbine combustor according to the present invention shown in FIG. 1, in which FIG. 2(*a*) is a sectional view in the axial direction of the main nozzle, FIG. 2(*b*) is a sectional view taken on line A-A in FIG. 2(*a*), and FIG. 2(*c*) is a sectional view taken on line B-B in FIG. 2(*a*).
Figure 3:
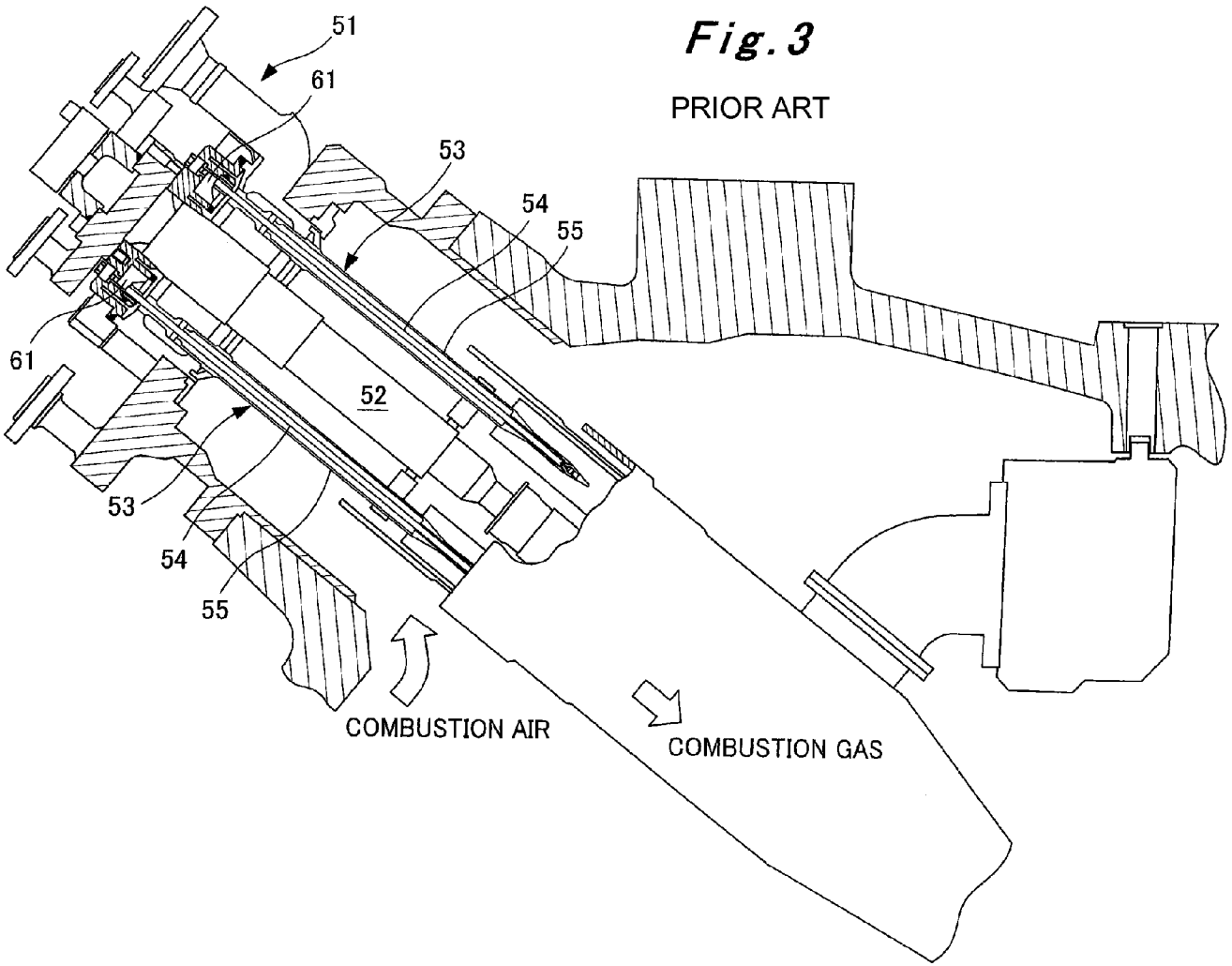
Fig. 3 PRIOR ART
FIG. 3 is a schematic view showing a conventional gas turbine combustor.
Figure 4A:
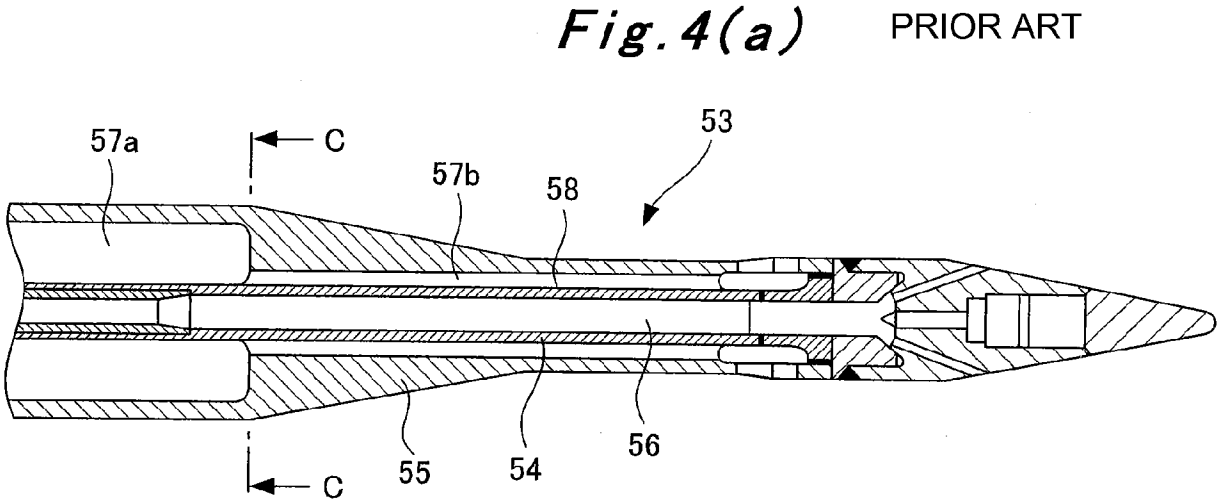
Fig. 4(a) PRIOR ART
FIGS. 4(*a*) and 4(*b*) are sectional views of a main nozzle in the conventional gas turbine combustor shown in FIG. 3, FIG. 4(*a*) being a sectional view in the axial direction of the main nozzle, and FIG. 4(*b*) being a sectional view taken on line C-C in FIG. 4(*a*).
Figure 4B:
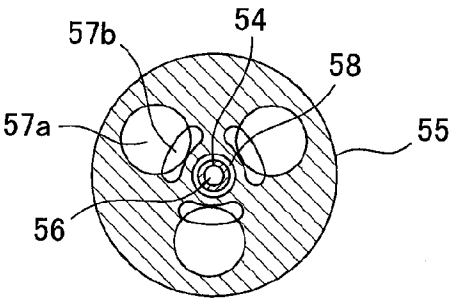
Fig. 4(b) PRIOR ART

FIGS. 2(*a*) to 2(*c*) are sectional views for illustrating the structure of the main nozzle 3 of the present embodiment. FIG. 2(*b*) is a sectional view taken on line A-A in FIG. 2(*a*), and FIG. 2(*c*) is a sectional view taken on line B-B in FIG. 2(*a*).

As shown in FIGS. 2(*a*) to 2(*c*), the main nozzle 3 of the present embodiment also has a cylindrical central tube 4 disposed at the center of the main nozzle 3, and the interior of the central tube 4 serves as an oil fuel path 6 through which oil fuel passes, as in the conventional technology. On the other hand, a gas fuel path 7 (7*a*, 7*b*), through which gas fuel passes, is formed by spaces between a cylindrical outer tube 5 disposed on the outermost periphery of the main nozzle 3 and a support tube 8 which is disposed between the central tube 4 and the outer tube 5.

The central tube 4 is formed from a standard pipe in common use, and its leading end part 4*a* is welded by Tig welding or the like to the interior of a leading end part 5*a* of the cylindrical outer tube 5 via the support tube 8 to be described later, while its rear end part 4*b* is welded by Tig welding or the like to a nozzle pipe base 11 for supporting the pilot nozzle 2 and the main nozzle 3. Further, a coiled bend 4*c* is provided in the vicinity of the rear end part 4*b* of the central tube 4 to accommodate displacements in the central tube 4 and the outer tube 5 due to thermal elongation differences between them and to suppress thermal stress. Unlike the conventional technology, therefore, the O ring becomes unnecessary, thus decreasing the number of the components, simplifying the structure, reducing the manufacturing cost, and enhancing the maintainability.

The support tube 8 independent of the central tube 4 and the outer tube 5 is provided on the outer peripheral side of the central tube 4 and the inner peripheral side of the outer tube 5. This support tube 8 has such an internal diameter as to form a clearance between the support tube 8 and the outer periphery of the central tube 4. An insulating air layer 9 is formed in this clearance to suppress the influence of the temperature of combustion air flowing around the main nozzle 3 and prevent the coking of oil fuel. In addition, this clearance is a tiny one measuring 0.2 mm or so. If the central tube 4 vibrates, therefore, the support tube 8 also functions as a steady rest or an anti-swing tool for it.

In order to form the insulating air layer 9, the support tube 8 is composed of a diameter varying tubular member whose inner peripheral side has a constant internal diameter consistent with the external diameter of the central tube 4, but whose outer peripheral side has a small diameter on the axially downstream side and has a large diameter on the axially upstream side. In more detail, the axially upstream side comprises a plurality of supporting portions 8*c* radially contacting the inner periphery of the outer tube 5, and a plurality of groove portions (gas fuel paths) 7*a* formed along the axial direction between the supporting portions 8*c*, and the axially downstream side comprises a cylindrical portion 8*b* having an external diameter equal to or smaller than the external diameter of the groove portions 7*a*. The inner periphery of the outer tube 5 is formed to have a small internal diameter on its axially downstream side and a large internal diameter on its axially upstream side in conformity with the outer periphery of the support tube 8.

A leading end part 8*a* of the support tube 8 is welded by Tig welding or the like to the interior of the leading end part 5*a* of the outer tube 5, while its rear end side contacts the inner peripheral side of the outer tube 5 by the supporting portions 8*c*, and is thereby supported by the interior of the outer tube 5. As described above, the support tube 8 has its axially front end side fixed to the central tube 4 and the outer tube 5 by welding, but has its axially rear end side merely in contact with the inner peripheral side of the outer tube 5, and is not fixed. The support tube 8 itself is structured to accommodate thermal elongation.

Thus, the section of the axially upstream side of the main nozzle 3, as shown in FIG. 2(*b*), is of a structure in which the plurality of (for example, six in the present embodiment) supporting portions 8*c* of the support tube 8 are arranged inside the outer tube 5, and the central tube 4 is disposed inside the supporting portions 8*c* via the insulating air layer 9. On the other hand, the section of the axially downstream side of the main nozzle 3, as shown in FIG. 2(*c*), is of a structure in which the cylindrical portion 8*b* of a tubular cross sectional shape of the support tube 8 is disposed inside the outer tube 5, and the central tube 4 is disposed inside the cylindrical portion 8*b* via the insulating air layer 9. In this manner, a so-called annular structure is formed.

In the main nozzle 3 of the above-described structure, the gas fuel path 7, through which gas fuel passes, is formed by the spaces between the outer tube 5 and the support tube 8. On the axially upstream side of the main nozzle 3, the spaces formed by the plurality of groove portions 7*a* and the outer tube 5 are used as the gas fuel paths 7*a*. On the axially downstream side of the main nozzle 3, the space formed by the cylindrical portion 8*b* and the outer tube 5 is used as the gas fuel path 7*b*.

Gas fuel passes through opening portions 5*b* provided in the side surface, on the axially upstream side, of the outer tube 5, and is supplied to the interior of the outer tube 5. The support tube 8 is extended to a side posterior of the position where the opening portions 5*b* are provided (namely, extended up to the nozzle pipe base 11). Moreover, notches 8*d* formed by partially cutting off the supporting portions 8*c* are provided at the positions of the support tube 8 corresponding to the opening portions 5*b* to guide gas fuel to the groove portions 7*a*. This is because the main nozzle 3 is structured such that the fluid force of gas fuel supplied from the opening portions 5*b* does not directly act on the central tube 4, whereby the vibration of the central tube 4 is prevented, and the flow of the inflowing gas fuel is not impeded.

In the main nozzle 3 of the above structure, the insulating air layer 9 directly contacts the support tube 8, and does not directly contact the outer tube 5. In addition, the support tube 8 does not directly contact the outer tube 5, at the cylindrical portion 8*b* on the axially downstream side. At the supporting portions 8*c* on the axially upstream side, too, the supporting portions 8*c* are radially formed, thereby minimizing the area of direct contact of the support tube 8 with the outer tube 5. Because of such a structure, the insulating air layer 9 functions sufficiently. As a result, the temperature of the central tube 5 can be kept down to the specified temperature or lower at which no coking occurs, so that the coking of oil fuel can be prevented reliably. Thus, when the main nozzle is designed and manufactured, its balance of heat input need not be taken into consideration, unlike the conventional technology. This makes it possible to reduce the costs of designing and manufacturing.

For example, the central tube 4 may be produced from a standard pipe, and the formation of the coiled bend 4*c* suffices, as stated earlier. In forming the coiled bend 4*c*, it is desirable to provide a straight portion in a part of the central tube 4 ranging from the rear end part of the support tube 8 to the coiled bend 4*c*, so that the inner periphery of the rear end part of the support tube 8 and the central tube 4 do not rub against each other even upon thermal elongation. For use as the outer tube 5, it is recommendable to have a bar member ready for use, and form a circular hole in the axial direction so that its internal diameter becomes small on the axially downstream side, as mentioned earlier. The outer tube 5 desirably has a thick wall at its portion 3*c* supported by the nozzle pipe base 11 in order to enhance the vibration strength of the main nozzle 3. For the support tube 8, it is recommendable to have a tubular member of varying diameter ready for use, form the plurality of groove portions 7*a* of U-shaped cross section in the axial direction of the portion with a large external diameter to form the supporting portions 8*c*, and partially form the notches 8*d* therein, as stated above.

As described above, the central tube 4, the outer tube 5, and the support tube 8 are prepared as separate members, whereafter the support tube 8 is fitted into the interior of the outer tube 5, the central tube 4 is disposed inside the support tube 8, and its leading end part is welded, thereby assembling the main nozzle 3 of the above structure. As seen above, in comparison with the conventional technology, the difficulty of design is low, and high accuracy machining is unnecessary. Consequently, machining and assembly are markedly easy as compared with the conventional technology, thus enabling the costs to be reduced.

With the main nozzle 3 of the above described structure, when oil fuel is used, oil fuel supplied from main nozzle oil chamber piping 12 (see FIG. 1) is passed through the rear end part 4*b*, the coiled bend 4*c*, and the leading end part 4*a* which become the oil fuel path 6, and is sprayed through an injection port 3*b* of the leading end part 3*a* of the main nozzle 3. Conventionally, if coking of oil fuel occurs, there has been a possibility of clogging occurring in the injection port 3*b*. In the present invention, as mentioned above, the influence of combustion air flowing around the main nozzle 3 is reliably prevented by the insulating air layer 9 to prevent the occurrence of coking of oil fuel, thereby preventing the clogging of the injection port 3*b*.

When gas fuel is used, on the other hand, gas fuel supplied from a main nozzle gas supply section 13 (see FIG. 1) is supplied to the gas fuel path 7 past a gas chamber 14, the opening portions 5*b*, and the notches 8*d*, is passed through the gas fuel paths 7*a* and the gas fuel paths 7*b* which become the gas fuel path 7, and is injected through the main nozzle 3.

INDUSTRIAL APPLICABILITY

The present invention is suitable for a gas turbine combustor in a dual mode in which fuel can be switched between oil fuel and gas fuel.

The invention claimed is:

1. A gas turbine combustor comprising at least one main nozzle provided with an oil fuel path for passage of oil fuel and a gas fuel path for passage of gas fuel, wherein the main nozzle comprises a cylindrical central tube disposed at a center of the main nozzle and using an interior thereof as an oil fuel path through which oil fuel flows, a cylindrical outer tube disposed on an outermost periphery of the main nozzle, and a support tube disposed between the central tube and the outer tube, the central tube, the outer tube and the support tube each being formed independently, wherein the support tube has such an internal diameter as to form a clearance becoming an insulating air layer between the support tube and an outer periphery of the central tube, and the support tube includes a plurality of supporting portions formed on an axially upstream side and radially contacting an inner periphery of the outer tube, thereby forming a plurality of groove portions formed along an axial direction between the supporting portions, and a cylindrical portion formed on an axially downstream side and the cylindrical portion having an external diameter equal to or smaller than an external diameter of the groove portions, and wherein the outer tube and the support tube define the gas fuel path therebetween.

2. The gas turbine combustor according to claim 1, wherein one or more opening portions are provided in a side surface, on the axially upstream side, of the outer tube, and one or more notches are provided by partially cutting off the supporting portions at positions where the opening portions are located, wherein gas fuel is to be supplied through the opening portions, and introduced from the notches to the groove portions.

3. The gas turbine combustor according to claim 1 or 2, wherein the central tube has a front end and a rear end fixed by welding, and has on a rear end side thereof a coiled bend formed in a coil-shape.

* * * * *